United States Patent [19]

Reddish, Jr.

[11] Patent Number: 4,608,156

[45] Date of Patent: Aug. 26, 1986

[54] MULTI-SCREEN GRAIN SEPARATOR

[76] Inventor: Arthur O. Reddish, Jr., 4121 S. 37th, Lincoln, Nebr. 68506

[21] Appl. No.: 313,709

[22] Filed: Oct. 21, 1981

[51] Int. Cl.[4] ..... B07B 1/52

[52] U.S. Cl. ..... 209/353; 209/358; 209/384; 209/385; 209/680

[58] Field of Search ..... 209/615, 616, 659, 680, 209/247, 261, 262, 316, 324, 352, 353, 354, 355, 358, 379, 381, 383, 384, 385, 389

[56] References Cited

U.S. PATENT DOCUMENTS

| | | | |
|---|---|---|---|
| 409,180 | 8/1889 | Ferguson et al. | 209/389 X |
| 420,966 | 2/1890 | Rose | 209/389 |
| 758,511 | 4/1904 | Doub | 209/389 X |
| 1,730,556 | 10/1929 | Callies | 209/379 X |
| 2,053,038 | 9/1936 | Mackenzie | 209/355 |
| 2,356,323 | 8/1944 | Kardos | 209/385 |
| 4,177,900 | 12/1979 | Kluthe | 209/358 X |

FOREIGN PATENT DOCUMENTS

| | | | |
|---|---|---|---|
| 474458 | 4/1929 | Fed. Rep. of Germany | 209/389 |

*Primary Examiner*—Robert B. Reeves
*Assistant Examiner*—Edward M. Wacyra
*Attorney, Agent, or Firm*—Pollock, Vande Sande & Priddy

[57] ABSTRACT

A separating apparatus for classifying particulate material according to size, including a sub-housing enclosing a horizontally extending cleaning screen. A plurality of separate conveyor mounted paddles sweep a top surface of the cleaning screen and a further plurality of paddles are biasing into sliding contact with a bottom surface of the cleaning screen to loosen clogs of particulate material clogged within the screen.

15 Claims, 5 Drawing Figures

MULTI-SCREEN GRAIN SEPARATOR

DESCRIPTION

Technical Field

The present invention is directed to a self-cleaning, multi-screen apparatus for separating solid particles such as feed grains according to size.

BACKGROUND

It is well-known to employ multi-screens for separating oversize and undersize impurities from a quantity of dry particles such as feed grain. U.S. Pat. No. 3,321,079 issued to Sackett, Sr. is believed typical of such prior art multi-screen devices. The main drawback of the Sackett device is a tendency for particles to clog one or more of the screens, effectively preventing the screens from filtering undesirable impurities from the main flow of particles.

In order to prevent the screens from becoming clogged with particles, it has been suggested in U.S. Pat. No. 1,644,537 issued to Meacham that scraper fingers sweep the vertically upper side of such screens. While such fingers can break up some clogs of particles extending upwardly from the screen, clogs of particles which become embedded in the screen openings are generally not disturbed by such fingers. The number of screen openings available for filtering undersize particles are thereby significantly reduced, resulting in a final product having an unacceptably large percentage of undersize particles and/or impurities.

A further approach to preventing the screens from clogging is suggested in U.S. Pat. No. 323,099 issued to Backus, wherein scraper fingers sweep beneath the screen to dislodge clogs extending downwardly from the screen openings. As with the Meacham device, the scraper fingers in Backus often fail to contact and dislodge clogs of particles embedded within the screen. As a result, undersize grain cannot pass through a significant number of the screen openings as desired.

DESCRIPTION OF INVENTION

A preferred embodiment of the present invention provides a particle separating apparatus which effectively overcomes the problems of screen clogging which continue to plague known devices. In particular, particles such as corn grain are directed onto a first, scalping screen having relatively large mesh which effectively scalps only oversize impurities or overs from the main flow. A plurality of paddle-type protrusions extend from an endless conveyor into close proximity with a vertically upper surface of the first screen. The paddles sweep the oversize particles downstream along the scalping screen and into an appropriately arranged outlet. On their return trip, the paddles sweep once scalped regular particles which have passed through downstream portions of the screen back into the main flow.

The main flow of once scalped particles is next directed onto a second, cleaning screen of relatively finer mesh ideally capable of filtering only undersize impurities or fines through the screen and into an outlet therebelow. A set of conveyor mounted, upper paddle-type protrusions sweep along the vertically upper side of the cleaning screen to push the remaining particles downstream along the second screen toward a product outlet. As the upper paddles make their return trip, they sweep any fines which pass through downstream portions of the cleaning screen back into the main flow of fines.

In order to prevent undersize particles from clogging the openings in the cleaning screen, a second set of conveyor mounted, lower paddle-type protrusions are spring-biased into contact with a vertically lower surface of the cleaning screen. These lower paddles sweep along the bottom side of the screen in the same direction as the upper paddles, though at a somewhat slower speed. Because the lower paddles apply continuous pressure against the cleaning screen, clogs of particles embedded in the screen tend to jostle loose when contacted by successive lower paddles. Furthermore, because the lower paddles bias the screen toward the upper paddles, the space for clogs to extend above the screen is reduced. The two sets of movable paddles cooperate with one another to sweep the cleaning screen free of even deeply embedded clogs of particles while, at the same time, directing twice cleaned particles to their appropriate outlet.

Because the scalping and cleaning screens are completely enclosed within a preferably metallic housing, the entire apparatus can be left outdoors year round. The apparatus is ideally suited for separating and cleaning corn, however, almost any grain can be cleaned of impurities by employing appropriately sized screens.

The present invention will become clear from a reading of the detailed description, wherein similar reference numerals are used to identify identical apparatus.

BRIEF DESCRIPTION OF THE DRAWINGS

The present invention can be best understood with reference to the attached drawings, wherein.

DETAILED DESCRIPTION OF THE PREFERRED EMBODIMENT

Figure 1:
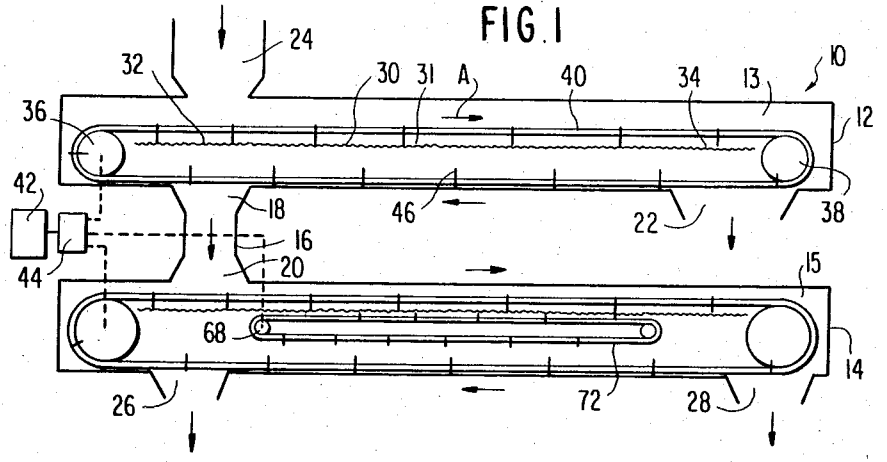
FIG. 1 shows a schematic representation of the self-cleaning, multi-screen separating apparatus.

With reference to FIG. 1, a multi-screen grain separation and cleaning apparatus is schematically indicated at 10. Apparatus 10 may, or may not be enclosed within a sheet metal housing, not shown for purposes of simplicity. Apparatus 10 includes a first sub-housing 12 preferably formed of sheet metal and defining a substantially rectangularly-shaped chamber 13. Finally, apparatus 10 includes a second sub-housing 14 also preferably formed of sheet metal, with sub-housing 14 also defining a substantially rectangularly-shaped chamber 15.

Sub-housing 12 is mounted generally above sub-housing 14, with a funnel-shaped vertical passageway 16 extending between an outlet 18, extending through a bottom wall of sub-housing 12 and an inlet 20 extending through a top wall of sub-housing 14. Sub-housing 12 includes a further outlet 22 extending through a portion of the bottom wall remotely spaced from outlet 18 for a reason which will become clear. Likewise, sub-housing 12 also includes an inlet 24 extending through a top wall and substantially vertically aligned with outlet 18. In a similar manner, sub-housing 14 includes a pair of outlets 26 and 28 formed through a bottom wall, with outlet 26 substantially vertically aligned with inlet 20 and outlet 28 substantially vertically aligned with outlet 22 in sub-housing 12.

Sub-housing 12 provides a first or scalping stage of separation apparatus 10, while sub-housing 14 provides a second or cleaning stage. A scalping screen 30 extends lengthwise through chamber 13 formed in sub-housing 12, with screen 30 preferably lying within a horizontal plane. A first end portion 32 of screen 30 extends directly beneath inlet 24 and above outlet 18. A further, opposite end portion 34 of screen 30 extends directly above outlet 22. A pair of sprockets 36 and 38 are rotatably journalled within sub-housing 12, and are disposed adjacent the opposite end portions 32 and 34, respectively, of screen 30. Transverse shafts extending between opposite side walls of sub-housing 12 for supporting sprockets 36 and 38 have not been shown for purposes of simplicity. An endless chain-like conveyor assembly 40 encircles sprockets 36, 38 and screen 30, and is mounted on the sprockets for joint movement therewith. A conventional power source, such as an electric engine, is schematically shown at 42 as being in driving communication with sprocket 36 via a conventional gear reduction assembly 44. When drive source 42 is energized, drive torque is transmitted to the support shaft on which sprocket 36 is journalled. Selective rotation of the support shaft causes a corresponding clockwise rotation of sprocket 36 as well as clockwise rotation conveyor of assembly 40 as indicated by the arrows A.

A plurality of separate paddle-type protrusions 46 are mounted for joint movement with conveyor assembly 40. Each protrusion 46 includes a first end portion extending into close proximity to an upper surface 31 of screen 30 during movement of the respective paddle-shaped protrusions between sprockets 36 and 38. Each paddle-shaped protrusion includes a further portion extending into close proximity with the bottom wall of sub-housing 12 during return movement of the respective paddle-shaped protrusion from sprocket 38 toward sprocket 36.

Figure 3:
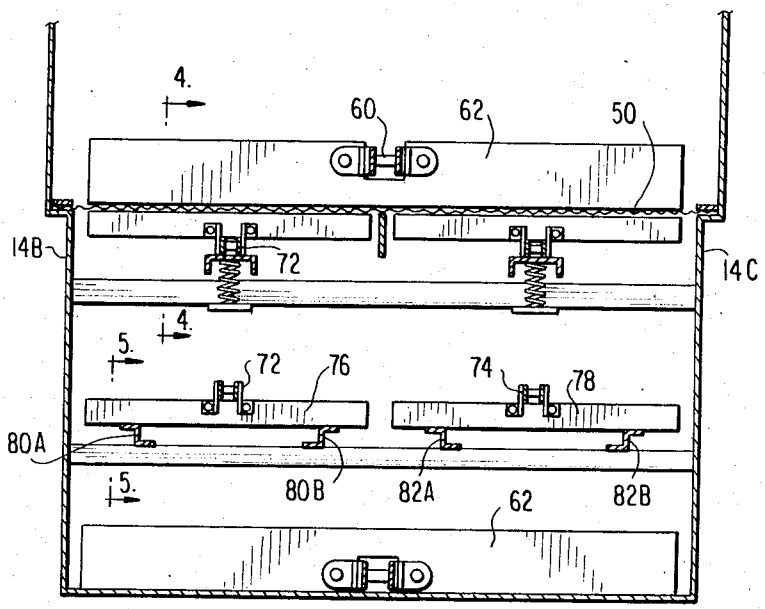
FIG. 3 shows a transverse cross-section taken along the plane 3—3 in FIG. 2.
Figure 5:
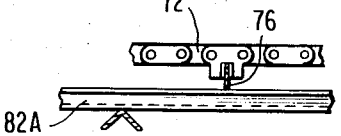
FIG. 5 shows a further partial section taken along the plane 5—5 in FIG. 3.

Turning now to FIG. 3, an enlarged view of sub-housing 14 is shown in section. A cleaning screen 50 is arranged within chamber 15 in a manner similar to screen 30. In particular, cleaning screen 50 extends along in a substantially horizontal plane running lengthwise through chamber 15. Cleaning screen 50 includes a first end portion 52 disposed beneath inlet 20 and above outlet 26 and further includes a second, opposite end portion 54 disposed above outlet 28. A pair of sprockets 56 and 58 are rotatably disposed adjacent the opposite end portions of screen 50, with each of the sprockets 56, 58 journalled on a separate shaft extending between side walls of sub-housing 14, not shown for purposes of simplicity. A chain-like conveyor assembly 60 includes sprockets 56 and 58 and screen 50. The shaft supporting sprocket 56 is attached to drive source 42 via gear reduction assembly 44 in a manner similar to sprocket 36. Upon selective actuation of drive source 42, sprocket 56 is caused to rotate in a clockwise direction, also causing chain-like conveyor assembly 60 to rotate in a clockwise direction about sprockets 56 and 58.

A plurality of separate paddle-type protrusions 62 are attached to spaced portions of chain-link conveyor assembly 60. Each protrusion has a substantially rectangular configuration and extends perpendicular to a longitudinal axis of conveyor assembly 60. Each paddle-type protrusion 62 as well as each paddle-type protrusion 46 is preferably formed of a molded plastic material. Protrusions 62 include a portion 64 which extends into close proximity with screen 50 as the respective protrusions 62 move from sprocket 56 toward sprocket 58. Likewise, each protrusion includes an end portion 66 which extends into close proximity with the bottom wall of sub-housing 14 as the respective protrusions return from sprocket 58 toward sprocket 56.

The conveyor assemblies 40 and 60 can be arranged to allow direct contact between the paddle-type protrusions and the respective screens 30 and 50. Alternatively, the paddle-type protrusion can be maintained slightly out of contact with their respective screen. In either case, each set of the paddle-type protrusions 46 and 62 functions to sweep the vertically upper surface of its respective screen during movement in a clockwise direction between the respective inlet and outlet openings in sub-housings 12 and 14.

Figure 2:
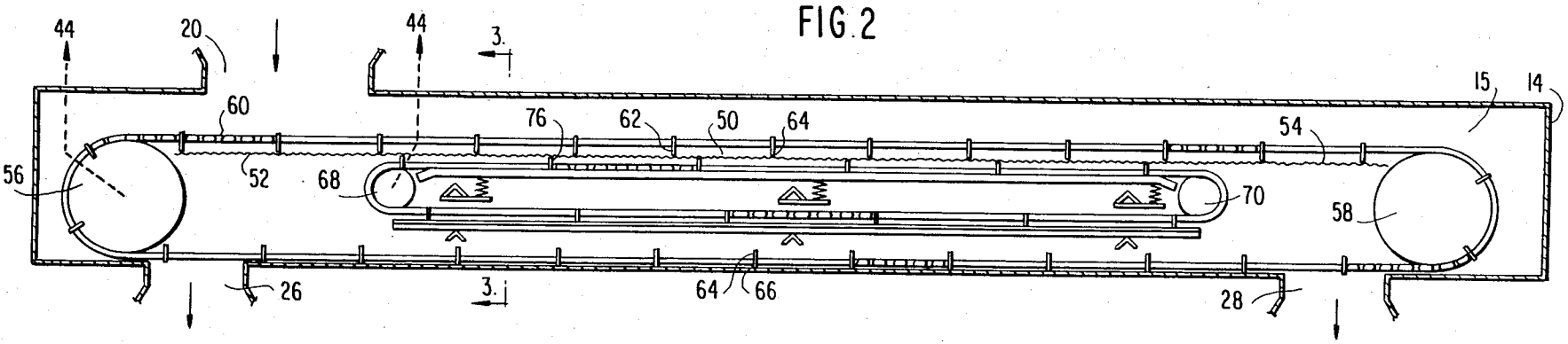
FIG. 2 shows an enlarged, longitudinal cross-section through a portion of the apparatus of FIG. 1.

The following portion of the specification discusses in detail the unique self-cleaning assembly mounted within sub-housing 14 for automatically disloding clogged particles embedded in or resting on screen 50. As shown in FIG. 2, a further pair of inner sprockets 68 and 70 are rotably journalled between sprockets 56 and 58. Each of the inner sprockets 68 and 70 is mounted on its own transverse support shaft, not shown, extending between opposite side walls identified at 14B and 14C in FIG. 3. Preferably, a further pair of inner sprockets are aligned with inner sprockets 68 and 70 and are disposed on the same transverse support shafts. The side by side inner sprockets are horizontally aligned with one another beneath screen 50, and drive source 42 is connected to the support shaft of one pair of inner sprockets including sprocket 68. Activation of drive source 42 causes inner sprocket 68 to rotate in a clockwise direction, also causing chain-link conveyor assembly 72 to rotate in a clockwise direction about inner sprockets 68 and 70. Likewise, chain-link conveyor assembly 74 is caused to simultaneously rotate in a clockwise direction about its inner sprockets, not shown.

A plurality of paddle-type protrusions 76 are attached to spaced portions of chain-like conveyor assembly 72, while a separate plurality of paddle-type protrusions 78 are similarly attached to chain-link conveyor assembly 74. Each of the protrusions 76 and 78 extends in a vertically upward direction toward screen 50 as the protrusions move in a clockwise direction between inner sprockets 68 and 70. Such an arrangement is clearly shown in FIGS. 2 and 3, respectively. Each of the paddle-type protrusions 76 and 78 is formed of molded plastic or a plastic like material. Each paddle 76 and 78 has a substantially rectangular configuration, with each pair of paddles 76 and 78 extending side by side across substantially the entire span of cleaning screen 50.

As conveyor assembly 72 returns toward inlet 20, paddles 76 ride along a pair of Z shaped channel members 80A and 80B mounted on an angle bar 82. Each of the channel members 80A and 80B is also formed of a plastic-like material to prevent any chance of sparks occurring within sub-housing 14. The paddles 78 mounted on chain-link conveyor 74 also slide along a pair of Z shaped channels 82A and 82B during their return trip toward inlet 20.

Figure 4:
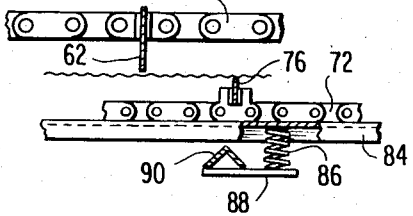
FIG. 4 shows a partial section taken along the plane 4—4 in FIG. 3.

Referring now to FIGS. 3 and 4, it is noted that chain-link conveyor assembly 72 rests on a substantially U-shaped channel 84 having open ends facing away from screen 50. Channel 84 is supported on a plurality of resilient biasing members which may take the form of compression springs 86. Each of the compression springs 86 is compressed between a channel 84 and a plate 88 fixedly attached to a support bar 90 extending from the side wall of sub-housing 14. Compression springs 86 function to bias channel member 84 towards screen 50. Because chain-link assembly 72 rests on channel 84, the chain-link and the paddle-shaped protrusions mounted thereon are also biased such than an end surface of each paddle 76 and 78 presses directly against a lower surface of screen 50. A separate pad of plastic-like material, not shown, may be placed between channel member 84 and chain-like conveyor assembly 72 to prevent the occurrence of sparks. Alternatively, the upper surface of channel member 84 could itself be formed of such a plastic-like material.

Operation of the present invention will now be described in detail. For purposes of explanation only, it will be assumed that scalping screen 30 is ¼ inch mesh wire and that cleaning screen 50 is of 7/32 inch mesh wire. A quantity of solid particles, such as unprocessed corn grain, is introduced into the separation apparatus 10 via inlet 24. Grain less than ¼ inch tends to filter directly through screen 30 and pass through outlet 18 directly into funnel 16. Oversize impurities are trapped on the upper surface of screen 30. These impurities are swept along screen 30 toward downstream end portion 34. As the oversize impurities are swept off of screen 30 by paddles 46, these impurities fall into outlet 22 and are either processed or disposed of. If any of the normal size grain should travel along a portion of screen 30 before filtering therethrough, these particles are swept along the bottom wall of sub-housing 12 as paddles 46 return toward sprocket 36. These once scalped grain particles are directed into outlet 18 where they rejoin the main flow.

The once scalped flow of grain falls through funnel 16 and inlet 20 until it lands on screen 50. Impurities less than 7/32 of an inch filter directly through the openings in screen 50 and exit separation apparatus via outlet 26. Normal size grain cannot pass through screen 50 and is trapped on the surface thereof. The paddle-shaped protrusions 62 moving adjacent to the upper surface of screen 50 sweep the grain particles along screen 50 toward downstream end 54. As the grain particles are literally pushed from the downstream end of screen 50 by paddles 62, the particles fall through outlet 28 and are collected.

At the same time that paddles 62 are moving adjacent to the upper surface of screen 50, paddles 76 and 78 are moving against the lower surface of screen 50. Any clogs of undersize grain particles which tend to clog in screen 50 are jostled free as the paddles push against the screen. A particular advantage of the present invention is the cooperation exhibited between the upper and lower sets of paddles 62, 76 and 78, respectively. For example, paddles 76 and 78 press screen 50 toward paddles 62, increasing the effectiveness of paddles 62 in dislodging clogs extending above screen 50. Likewise, the compression springs 86 allow sufficient downward movement of paddles 76 and 78 to ensure that impurities stuck in and extending below screen 50 do not jam the lower paddles from movement relative to screen 50. The lower paddles 76 and 78 tend to beat clogs from screen 50 without damaging the screen material itself.

In a preferred embodiment, each of the endless chain conveyor assemblies 72 and 74 moves at a speed approximately one-half the speed of endless chain-link conveyor assembly 60, which is also preferably the speed of endless chain-link assembly 40. The size of cleaning units within sub-housings 12 and 14 is a design choice. For example, the screens 30 and 50 may be 25 feet or longer depending on the flow rate of the apparatus. Likewise, the apparatus is adaptable for scalping and cleaning a variety of grains including wheat as well as corn. In a preferred embodiment, an electric motor is employed for driving each of the conveyor assemblies, with paddles 46 and 62 moving at 43 rpm and the inner paddles 76, 78 moving at 27 rpm.

The above description is not intended to limit the scope of the present invention, rather, the present invention is only intended to be limited by the scope of the claims following hereafter.

What is claimed is:

1. A separating apparatus for classifying particulate material according to size comprising:

a cleaning sub-housing defining a chamber enclosing a substantially horizontally extending cleaning screen, said sub-housing having a top wall disposed above said screen with an inlet located vertically above an upstream end of said cleaning screen, said sub-housing having a bottom wall disposed beneath said screen with a first outlet located beneath said upstream end and aligned with said inlet and said bottom wall having a second outlet located beneath a downstream end of said screen;

conveyor mounted paddle means for repeatedly sweeping particulate material along a top surface of said cleaning screen from said upstream end toward said downstream end;

conveyor mounted protrusion means for repeatedly sweeping a bottom surface of said cleaning screen from said upstream end toward said downstream end; and biasing means for biasing said protrusion means into continuous contact with said bottom surface of said cleaning screen comprising at least one compression spring compressed between a surface rigidly mounted within said sub-housing and a floating channel member confronting and extending parallel to said cleaning screen, whereby said at least one compression spring biases said floating channel member against a plurality of said protrusion means, pressing said protrusion means against the bottom surface of said cleaning screen, thereby freeing said cleaning screen of impurities which inadvertently become embedded therein.

2. A separating appartus according to claim 1, wherein said conveyor mounted paddle means comprises a plurality of separate paddle members spaced from one another, each of said paddle members being attached to an endless chain-link conveyor encircling said cleaning screen and a pair of sprockets rotatably mounted adjacent said upstream and downstream ends of said cleaning screen.

3. A separating apparatus according to claim 2, wherein each paddle member includes an end surface confronting and substantially spanning the top surface of said cleaning screen as said paddle members move from said upstream end toward said downstream end.

4. A separating apparatus according to claim 2, wherein drive means is disposed for effecting clockwise rotation of at least one of said pair of sprockets and said endless chain-link conveyor mounted thereon, whereby said conveyor transports each paddle member along the top surface of said cleaning screen.

5. A separating apparatus according to claim 2, wherein each paddle member is formed of a plastic-like material and has a substantially rectangular configuration.

6. A separating apparatus according to claim 2, wherein each paddle member includes a further end surface sweeping along the bottom surface of said sub-housing as each paddle member moves toward said upstream end of said cleaning screen.

7. A separating apparatus according to claim 1, wherein at least one endless chain-link conveyor is disposed beneath said cleaning screen, said conveyor encircling a pair of sprockets located beneath upstream and downstream ends of said cleaning screen.

8. A separating apparatus according to claim 7, wherein drive means is disposed for effecting clockwise rotation of at least one of said pair of sprockets and said endless chain-link conveyor mounted thereon, whereby said conveyor transports each of said protrusions along the bottom surface of said cleaning screen.

9. A separating apparatus according to claim 7, wherein said protrusion means comprises a plurality of separate paddle members each having an end surface spanning at least a portion of the bottom surface of said cleaning screen.

10. A separating apparatus according to claim 9, wherein each of said paddle members has a substantially rectangular configuration and is formed of a plastic-like material.

11. A separating apparatus according to claim 1, wherein said biasing means comprises a plurality of separate compression springs each compressed between a rigidly disposed surface and said floating channel member.

12. A separating apparatus according to claim 1, wherein a scalping sub-housing is disposed above said cleaning sub-housing, said scalping sub-housing defining a chamber enclosing a substantially horizontally extending scalping screen, said scalping sub-housing having an inlet formed in a top wall and located above an upstream end of said scalping screen, said scalping sub-housing having a pair of outlets formed in a bottom wall, one of said outlets being disposed vertically beneath said inlet and the remaining outlet being disposed vertically beneath a downstream end of said scalping screen.

13. A separating apparatus according to claim 12, wherein an endless chain-link conveyor encircles said scalping screen and a pair of sprockets disposed adjacent said upstream and downstream ends of said scalping screen.

14. A separating apparatus according to claim 13, wherein a plurality of separate paddle members are attached to spaced portions of said endless chain-link conveyor, each of said paddle members having a surface repeatedly sweeping along a top surface of said scalping screen from said upstream end toward said downstream end.

15. A separating apparatus according to claim 12, wherein said scalping screen includes a plurality of openings and said cleaning screen includes a plurality of openings, said openings formed in said scalping screen each being larger in size than respective openings formed in said cleaning screen.

* * * * *